US007814850B2

(12) United States Patent
Bearden

(10) Patent No.: US 7,814,850 B2
(45) Date of Patent: Oct. 19, 2010

(54) TUFTING MACHINE FOR PRODUCING ATHLETIC TURF HAVING A GRAPHIC DESIGN

(75) Inventor: John H. Bearden, Woodstock, GA (US)

(73) Assignee: Partner's Royalties, LLC, Woodstock, GA (US)

( * ) Notice: Subject to any disclaimer, the term of this patent is extended or adjusted under 35 U.S.C. 154(b) by 459 days.

(21) Appl. No.: 11/952,036

(22) Filed: Jan. 15, 2008

(65) Prior Publication Data

US 2008/0134949 A1 Jun. 12, 2008

Related U.S. Application Data

(60) Provisional application No. 60/868,729, filed on Dec. 6, 2006.

(51) Int. Cl.
*D05C 15/20* (2006.01)
*D05C 15/22* (2006.01)
*D05B 69/10* (2006.01)

(52) U.S. Cl. ..... 112/80.4; 112/80.5; 112/98; 112/220

(58) Field of Classification Search ... 112/80.01–80.56, 112/470.09, 98, 103, 220, 221
See application file for complete search history.

(56) References Cited

U.S. PATENT DOCUMENTS

| | | | | | |
|---|---|---|---|---|---|
| 3,450,076 | A | * | 6/1969 | Bender | 112/80.4 |
| 3,515,080 | A | * | 6/1970 | Ramsey | 112/470.13 |
| 3,749,037 | A | * | 7/1973 | Cash | 112/117 |
| 4,173,192 | A | * | 11/1979 | Schmidt et al. | 112/80.24 |
| 4,669,406 | A | | 6/1987 | Muroya | |
| 4,790,252 | A | | 12/1988 | Bardsley | |
| 4,829,917 | A | | 5/1989 | Morgante et al. | |
| 4,864,947 | A | * | 9/1989 | Iwase | 112/470.13 |
| 4,876,973 | A | * | 10/1989 | Marrache et al. | 112/470.13 |
| 5,103,747 | A | * | 4/1992 | Resta et al. | 112/117 |
| 5,743,200 | A | | 4/1998 | Miller et al. | |
| 5,979,344 | A | | 11/1999 | Christman, Jr. | |

* cited by examiner

*Primary Examiner*—Ismael Izaguirre
(74) *Attorney, Agent, or Firm*—Invention Protection Associates, LLC

(57) ABSTRACT

A tufting machine capable of producing individual articles of athletic turf bearing precise graphic patterns is disclosed. The machine includes a support frame to which a backing material is statically held, a tufting frame that spans above and below the backing and is computer-controlled to travel along the support frame, a yarn-inserting needle carriage disposed above the backing along the tufting frame and a yarn-catching looper carriage disposed below the backing along the tufting frame. The carriages are computer-controlled to asynchronously shift relative to each other as may be necessary for their individual yarn-inserting components and yarn-catching components to cooperate.

19 Claims, 7 Drawing Sheets

TUFTING MACHINE FOR PRODUCING ATHLETIC TURF HAVING A GRAPHIC DESIGN

This nonprovisional application claims the benefit of provisional application 60/868,729.

BACKGROUND

The present invention generally relates to tufting machines, and it is specifically directed to a tufting machine that has a tufting head comprised of distinct yarn-inserting and yarn-catching/cutting elements that are independently movable relative to each other in order to facilitate the production of artificial athletic turf bearing multi-colored graphic designs.

Many of the aspects and features of machines for manufacturing tufted products have evolved considerably over the years. Conventional broadloom tufting machines have been designed to enable the manufacture of carpet and artificial athletic turf in high volume. Such high output tufting machines typically feature a backing feed mechanism comprising an arrangement of feed and take-up rollers that feed an elongate sheet of backing fabric past a tufting head. The tufting head portion of the machine generally features one or more elongate needle bars having hundreds of aligned tufting needles which are disposed above the backing sheet, as well as an equivalent plurality of loopers that are disposed below the backing. Each needle bar carries a row of aligned needles that each receive yarn, via any of a variety of suitable yarn feed mechanisms, from a corresponding spool situated within a yarn creel. As the backing sheet is conveyed past the tufting head, the needles are continually reciprocated downward to penetrate and insert yarn into the backing sheet. The loopers operate in synchronicity with the needles so that as each needle momentarily protrudes the backing, a corresponding looper catches its yarn before the needle returns upward. This cooperative needle and looper action produces "loop pile" tufts of yarn in the backing. Additionally, knives can be used to sever each of the just-formed loops to render "cut pile" tufts.

Where uniformly patterned carpet or vast monochrome sections of athletic turf are to be produced, the needle bar of the type of broadloom tufting machine used may span the entire transverse width of the backing material. Thus, the tufting needles along the needle bar generally remain stationed at constant axial positions (i.e., the needle bar does not shift laterally with respect to the backing). The incremental, longitudinal progression of the backing material that follows each stroke of the needle bar causes the laterally-aligned needles to form successive lateral rows of tufts. However, while broadloom tufting machines that employ single axis needle bar movement may be preferable for high output production of tufted products of uniform tuft placement and yarn color, they are not ideal for tufting multicolored designs. For creating multicolored tuft patterns in backing materials, such as may be necessary when manufacturing the logo-bearing sections of artificial athletic turf, tufting machines have been improved to enable their needle bars to shift laterally, relative to the backing, in order that the particular type of yarn delivered by particular individual needles be selectively inserted into the backing at specific tuft locations in accordance with a preconceived pattern. For example, U.S. Pat. No. 4,829,917 to Morgante, et al. discloses the use of a computer-controlled hydraulic actuator for shifting the needle bar of a tufting machine into different lateral positions in response to preselected stitch pattern information stored in the computer. As another example, U.S. Pat. No. 5,979,344 to Christman, Jr. discloses the use of computer-controlled inverse roller screw actuators for shifting needle bars laterally, as well as for shifting the backing sheet itself laterally, in order to tuft a graphic pattern of yarn into the backing as it advances longitudinally past transversely aligned needles.

However, conventional tufting machines that employ backing feed mechanisms are not optimum for producing highly detailed color images, such as some artistic logo-bearing sections of artificial athletic turf, even if their tufting heads are laterally shiftable. For one, their tufting heads generally perform needle reciprocation and shift in timed relationship with the stepped longitudinal progression of the backing fabric that is being fed through the machine. Whenever that motion relationship is altered, as may occur unintentionally for a variety of reasons, the tufting needles may fail to insert yarn tufts at the precise positions necessary to produce the desired image effect. For example, if the backing feed mechanism experiences any lag or surge in its operation, that will likely create inconsistency in the longitudinal spacing between adjacent rows of tufts which, in turn, could distort the overall graphic image being tufted.

Furthermore, athletic field logos, for example, are often broader than the tufting zones of conventional machines—which are typically up to 15 feet wide. Therefore, graphic logos often must be manufactured in separate sections. The sections are individually tufted and then glued, side-by-side, onto a base layer material to form the whole image. However, using a conventional tufting machine with a backing feed mechanism to tuft the various adjacent sections of backing separately can be problematic, not only because the machine may experience operating irregularities in the cooperative motions of its tufting head and backing feed mechanism, but also due to inherent characteristics of the backing material itself. To with, backing sheets are typically fabricated of coarsely woven material that may be stretched nonuniformly or skewed as they are advanced by the backing feed mechanism. Consequently, there exists the potential for one image-bearing section of backing to progress through the tufting zone differently, in some respect, than does an adjacent section, and that may render color discontinuity within the assembled tufted image.

To address this issue, tufting machines have been developed to enable the tufting head component of the machine to advance multi-directionally and along perpendicular axes in order to tuft a pattern into a fixedly held backing piece. U.S. Pat. No. 5,743,200 to Miller, et al. discloses such an apparatus for manufacturing tufted rugs. Resembling the construction of the machine of the present invention, the Miller tufting machine employs a gantry component which carries a tufting head adapted to move along an X-axis (i.e., lateral relative to the backing), while the gantry is movable along a Y-axis (i.e., longitudinal relative to the backing). The Miller tufting head is disposed above the backing material, and it is mounted to the gantry via its attachment to a frame which is gearably connected to and movable along the gantry. The tufting head generally comprises a cylinder that is slidably secured to the frame, a piston that reciprocates within the cylinder, a needle that is secured to the bottom end of the cylinder and a blade that is positioned within the needle and is secured to the bottom of the piston. The blade projects from and retracts into the needle to assist the needle in protruding down through the backing to form loop pile tufts therein. The Miller tufting machine also includes a second, lower gantry that is disposed below the backing material and moves along a Y-axis in synchronicity with the upper gantry. This lower gantry provides underlying support for the backing material in order to limit the downward deflection that would otherwise result from the pressure applied by the blade and needle operating on the backing.

Nevertheless, it can be appreciated that there is an outstanding need for a tufting machine that has a configuration which is similar in that it includes a computer controlled tufting head adapted to move along both X and Y axes and entirely about a statically held backing piece upon which it operates in order to insert various yarns into the backing at precise locations in accordance with a design pattern stored in the computer, but that includes an improved tufting head configuration for producing athletic turf products of precise graphic design. More specifically, there is a need for such a machine to employ a tufting head that is defined by two distinct and asynchronously driven parts which constitute: (a) a needle carriage which is oriented above a statically held sheet of backing material being tufted and comprises a number of individually controlled needles that are each threaded with a separate color of yarn and are selectively reciprocated along a Z-axis to insert those yarns into the backing material as the carriage journeys along an X-axis; and (b) a looper carriage which is oriented below the backing and is not mechanically connected to the needle carriage, but rather is selectively advanced and retracted, along a parallel axis, in order for its looping element to catch and its cutting element to cut the yarn being injected through the backing by the particular needle carriage needle in tufting action. Furthermore, there is a need for the looper carriage to include a fewer number of looping and cutting parts than the quantity of needles disposed within the needle carriage and for the looper carriage to, therefore, be able to shift to and fro in non-unison with the needle carriage so that a single looper and cutter pair may selectively cooperate with each one of multiple needles. Such a tufting head configuration lends itself to avoiding an issue of the minimum needle gauge achievable (i.e., the minimum spacing required between adjacent needles) being dictated by how closely adjacent looper and knife pairs can be disposed within a looper carriage of a type that features a separate looper and knife pairing for cooperation with each needle disposed in the needle carriage. The tufting machine of the present invention substantially fulfills these outstanding needs.

SUMMARY OF THE INVENTION

It is an object of the present invention to provide an apparatus that employs individual needle control capability ing tufting a multicolored yarn pattern into a statically held backing fabric. In one aspect of the invention, the apparatus features a support frame to which the ends of sheet of backing material are clamped so that the backing is held in plane under uniform tension while being worked upon by a tufting head that moves about the backing. By holding the backing static, rather than feeding it through the machine during tufting, the present tufting machine exercises greater control over individual tuft position accuracy, as the backing is prevented from skewing like it could if conveyed by a feed mechanism of some sort. Furthermore, eliminating the aspect of advancing the backing material from the tufting process allows separate pieces of backing, which are to be adjacently laid upon and adhered to a separate base material, to be tufted with precise symmetry and continuity of their respective rows of yarn tufts.

In another aspect of the invention, the apparatus features at least one tufting frame which is formed by a parallel beam structure that is oriented along an X-axis and is mounted to the support frame in a way that permits the beams to travel in either direction along a Y-axis. More specifically, the tufting frame is connected to and propelled along the support frame via a frame drive mechanism which may be comprised of: (a) a pair of timing belts attached to the lateral ends of the support frame and oriented along parallel Y-axes; (b) a pair of tufting frame-mounted gears that engage the belts; and (c) servomotors capable of rotating each gear bi-directionally to propel the tufting frame along the support frame. The servomotors are controlled by a computer within which the graphic pattern to be tufted is stored. In another aspect, the tufting head of the apparatus is movably mounted to the tufting frame in much the same fashion as the tufting frame itself is to the support frame. Thus, the tufting head is able to travel laterally (i.e., along an X-axis) relative to the backing in order to construct lateral tuft rows thereupon and, via tufting frame movement, the head travels longitudinally in order to initiate construction of new lateral tuft rows.

It is another object of the invention to provide a tufting head configured to efficiently construct precise linear tuft rows comprised of different colors of yarn. In one aspect of the invention, the tufting head is formed by two distinct and independently movable carriages which are not mechanically linked and are disposed on opposite sides of the backing sheet, yet which interact to produce cut pile tufts of the type ordinarily found in artificial athletic turf. To accommodate a tufting head of such construction, the tufting frame to which it is mounted features two horizontal and X-oriented beams that respectively span above and below the horizontally suspended backing. The "tufting head" itself is formed by: (a) a needle carriage which is movably mounted to the aforementioned upper beam and includes multiple needles which are each selectively reciprocated in order to insert different colored yarn into the backing fabric; and (b) a looper carriage which is movably mounted to the lower beam and that includes a conventional yarn looper for catching yarn on a needle's downward stroke and then holding it in place as the needle returns upward to, thereby, form a yarn loop, and that further includes a cutting knife for severing the just formed loop to render a cut pile. By virtue of the tufting frame's ability to advance in Y-directions along the support frame and the ability of the tufting head carriages to travel in X-directions along the tufting frame, the tufting needles are able to assume precise lateral and longitudinal tufting positions for inserting yarn in accordance with a detailed graphic pattern stored in the computer.

However, in another aspect of the invention, unlike the two motors which operate in unison to advance the tufting frame in either Y-direction, the two computer-controlled servo motors that propel the tufting head carriages in X-directions each output rotation independent of that produced by the other. This independent relationship enables a lower carriage possessing as few as one looper and knife pair to fully cooperate with a needle carriage possessing as many different needles as are needed to tuft the various colors of yarn that make up a particular graphic pattern. To with, just before an individual needle is pushed into the backing material by its dedicated drive mechanism, the lower carriage shifts into a lateral position that will enable its looper to engage the yarn delivered by that needle. As a further consequence of the single looper and knife configuration of the present tufting head, rather than the minimum needle pitch achievable being partly dependent upon the amount of lateral space needed to station, along the looper carriage, separate loopers and knives in cooperative alignment with each needle, adjacent needles can be positioned as closely as the girth of their respective needle holding elements and reciprocation drive mechanisms will permit.

This aspect of the machine is particularly important due to the how the tufting head traverses the backing fabric, during the tufting process, in order to tuft yarn row-by-row. To wit, in creating each row of tufts, the needle carriage generally advances in one lateral direction while its individually controlled needles selectively insert their yarns. If the row being created is to contain different yarns (ex: red and blue), occasionally, a trailing needle threaded with one color of yarn will need to remain idle while advancing past a segment of its designated tufting positions while a leading needle carrying a different colored yarn is commanded to insert a continuous span of its yarn along a segment of its designated tufting positions within that row. Then, when the leading needle finishes its segment, the needle carriage will reverse course in order to reposition the trailing needle to initiate tufting along its previously neglected stretch of tufting positions. By minimizing needle gauge, the cumulative distance of reverse travel by the needle carriage is effectively reduced, and the amount of time consumed in tufting a complete multicolored row is reduced accordingly.

It is another object of the invention to provide a tufting head configured to minimize the quantity of parts that are subject to wear and, eventually, fail from usage. Employing a single looper and knife to engage the yarn of multiple needles makes the present apparatus considerably easier to maintain than most conventional tufting machines that have a separate looper and cutter stationed to correspond with each of multiple tufting needles. One obvious reason for that is the fact that, with the present machine, only one looper or cutter ever needs replacing. Furthermore, if the looper ever fails during use, the needle carriage can be repositioned and the machine set to resume executing the exact same tufting sequence beginning at the precise position that the needle carriage was at when the looper failed. However, when a looper on a prior art tufting machines fails, the tuft row left partially uncompleted due to the failure might have to be completed by manual tufting in order to avoid the yarn overlapping that might result from re-running its tufting head over backing positions at which yarn loops were successfully formed, before the prior art machine was stopped, by other loopers that continued functioning properly.

Another object of the present invention is to allow a user to selectively control the height of tuft piles formed. In one aspect of the invention, the tufting head features a foot which is attached to the looper carriage and extends upward therefrom to provide underlying support for the backing material above. Adjusting the vertical position at which the looper is attached to the looper carriage correspondingly adjusts the vertical spacing between the foot and looper directly affects the height of the yarn piles formed along the backing.

It is yet another object of the present invention to increase production efficiency by allowing multiple tufting heads to work on different sections of a backing fabric simultaneously. For example, separate tufting heads (i.e., separate needle and looper carriage pairings) can be mounted along the same tufting frame, with the heads operating on different width sections of the backing. Alternatively or additionally, multiple tufting frames can be mounted along the support frame of the tufting machine, with the tufting head(s) attached to each tufting frame operating on a separate length section of the backing.

DETAILED DESCRIPTION OF THE PREFERRED EMBODIMENTS

Figure 1:
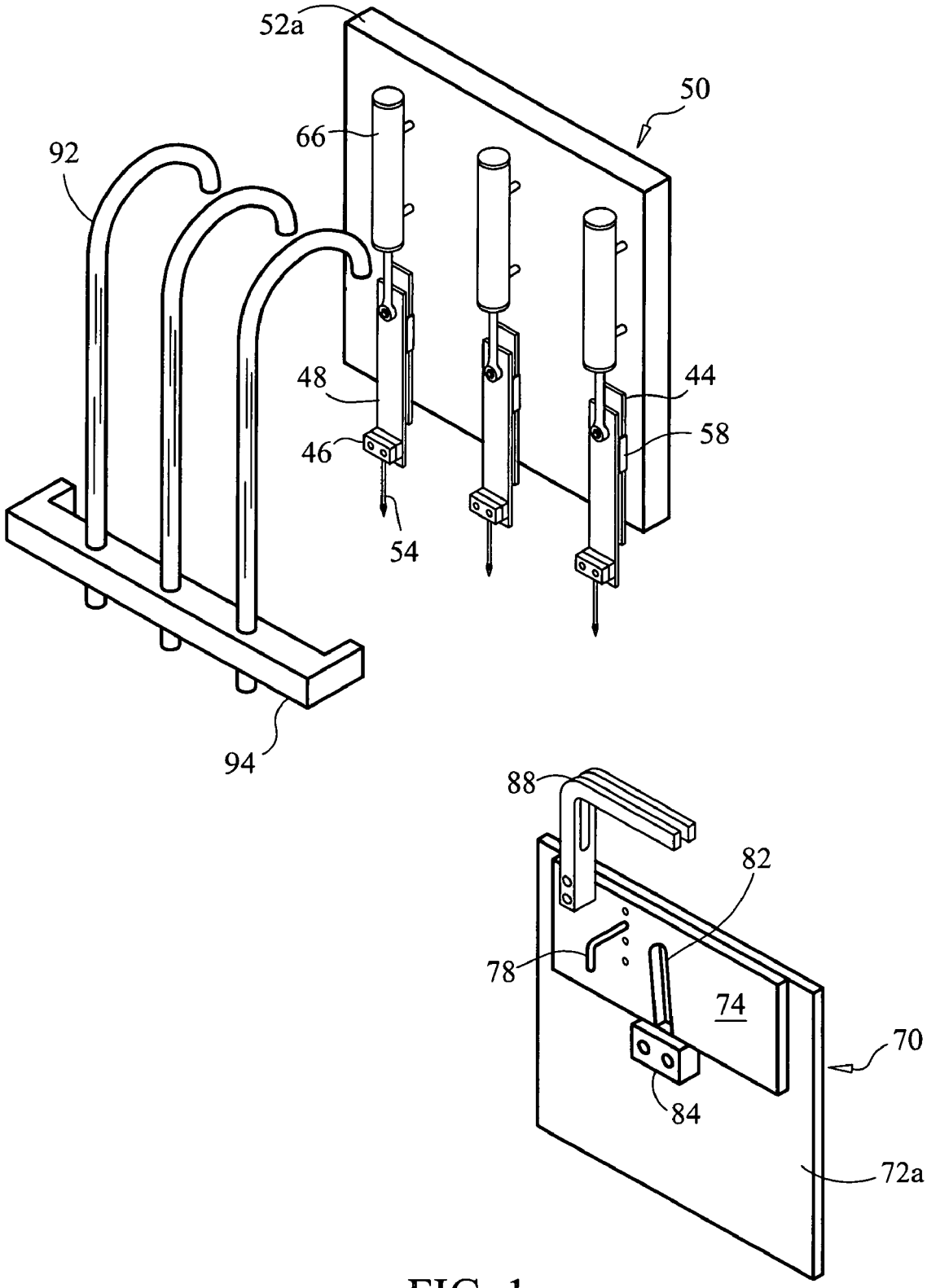
FIG. 1 is an exploded front perspective view of the needle carriage and looper carriage of an embodiment of the tufting machine of the present invention, shown with the needle carriage partially intact.

It should be understood that the present disclosure has particular applicability to machines used for manufacturing graphically designed portions of artificial athletic turf and other cut pile articles, but it can be applicable to tufting machines generally. This disclosure, as embodied in FIGS. 3-5, relates to a tufting apparatus 1 which can be viewed as generally comprising three basic elements: an apparatus support frame 2, a tufting frame 20 and a tufting head which, itself, comprises a needle carriage 50 and looper carriage 70. Additionally, a computer 100 is used to control all of the selective motions imparted by various drive components of the apparatus 1 throughout its operation. It is particularly important that the tufting frame 20 be movable along a Y-axis relative to the support frame 2, that the tufting head be movable along an X-axis relative to the tufting frame 20 and that, as will be explained, yarn-receiving looper carriage components 70 of the tufting head be movable along an X-axis relative to its separate yarn-delivering needle carriage components 50. However, a more detailed understanding of the present disclosure will be gained through a discussion thereof below in connection with the drawings provided herein.

Figure 3:
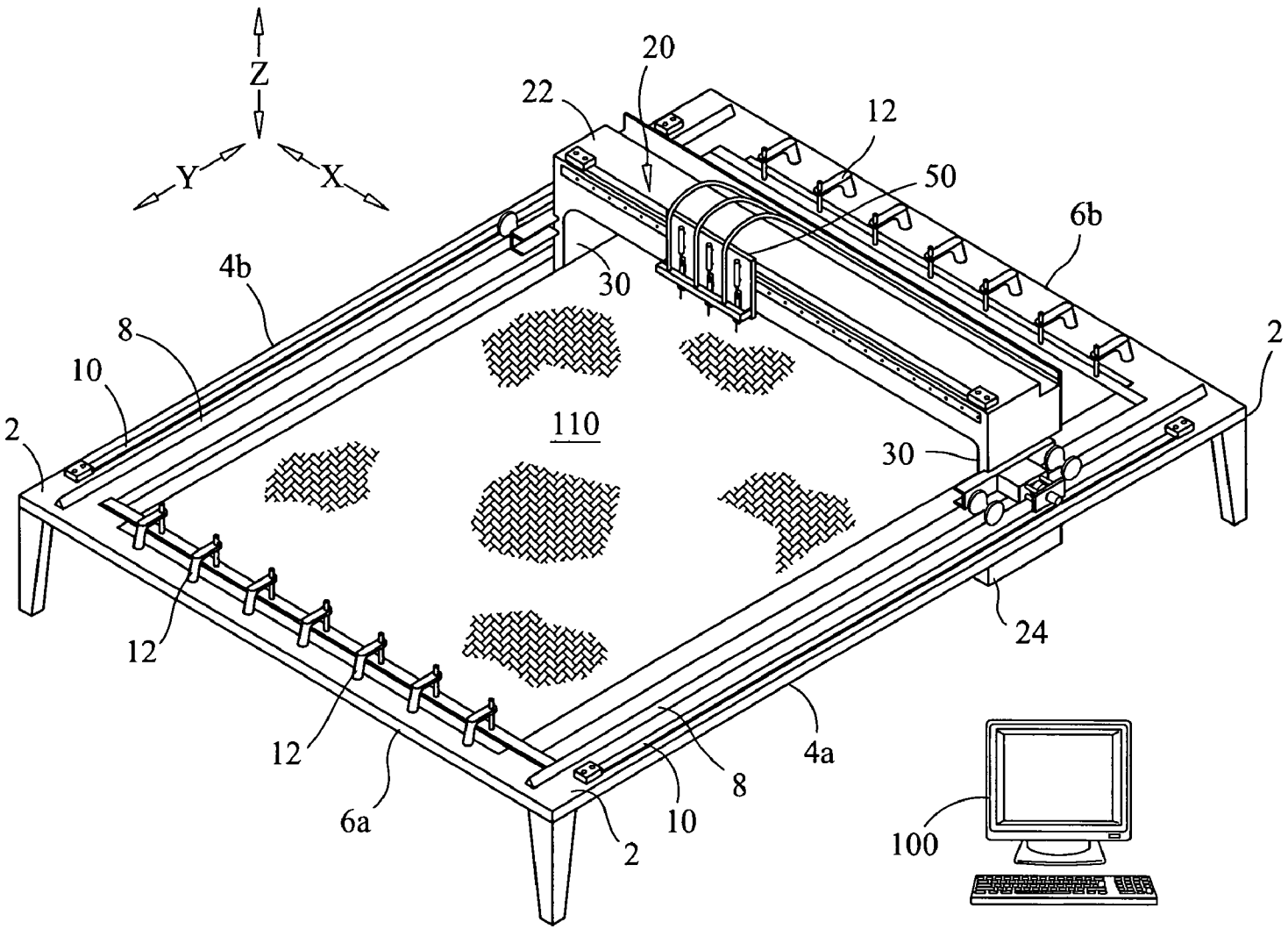
FIG. 3 is a perspective view of an embodiment of the tufting machine of the present invention.

A typical example of an article of backing material to be worked upon by the present machine is fabricated of tightly woven material of a type normally used in the manufacture of artificial athletic turf. As illustrated in FIG. 3, a sheet of such backing material 110 is fastened to the apparatus support frame 2 by way of clamping mechanisms 12 which are stationed along both longitudinal ends 6 of the support frame 2. The backing 110 should be clamped taut so that it suspends in a horizontal plane without sagging appreciably. A typical backing sheet 110 to be worked upon may have a width of 15 ft. and length of 30 ft. Thus, the table-like apparatus support frame 2 has a generally rectangular, open bed area 14 (see FIG. 5) of like dimensions. The height of the support frame 2 should be such that a user can fully view tuft formation along the backing 110 and, if necessary, can manually operate on various components of the machine's tufting head without having to uncomfortably squat or bend and without having to be elevated.

Figure 4:
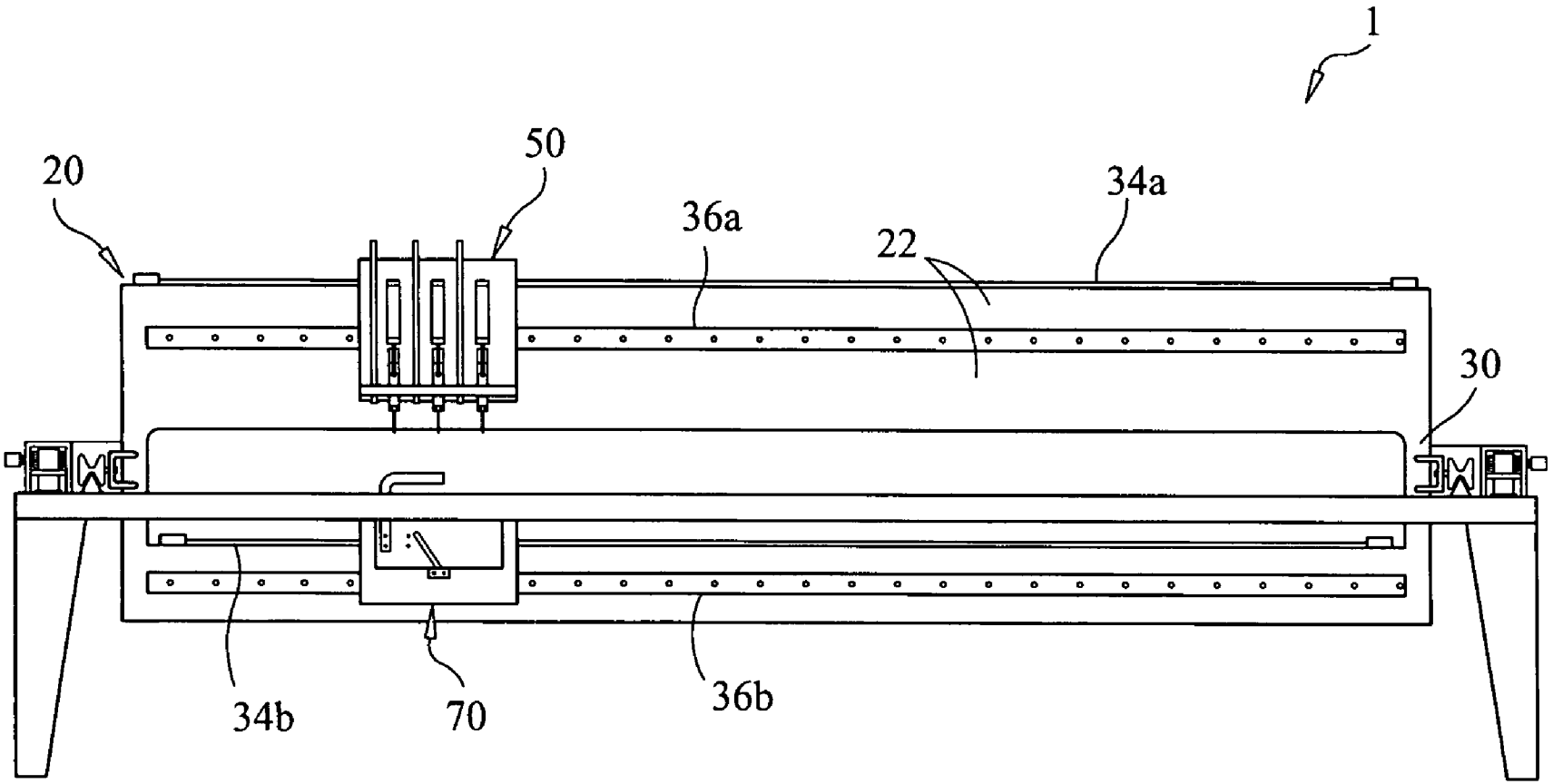
FIG. 4 is a front elevational view thereof.
Figure 5:
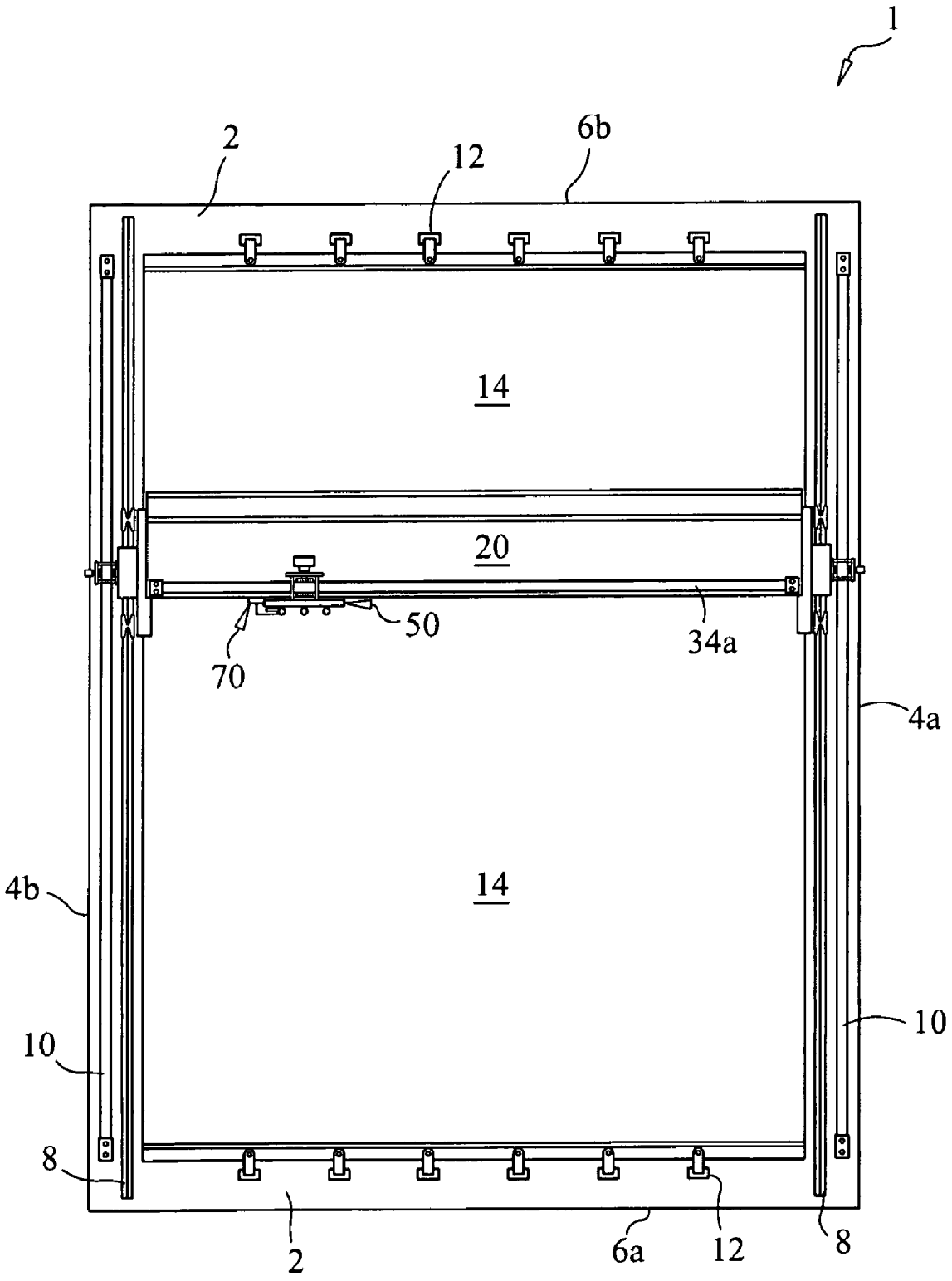
FIG. 5 is a top plan view thereof.

As depicted in FIGS. 3 & 4, the tufting frame 20 is a parallel beam structure. It comprises a pair of vertical supports 30 positioned at lateral sides of the support frame 2 and which join two horizontal beams 22, 24 that are disposed in spaced, vertically coplanar alignment. The upper beam 22 of the tufting frame 20 spans laterally over the backing 110, while the parallel lower beam 24 extends underneath the backing 110. The tufting frame 20 is movably mounted to the support frame 2 by way of a tufting frame drive mechanism, of some configuration, which is controlled by the computer 100. In one embodiment, the drive mechanism is partially formed by a rack and gear assembly which includes rails 8 as well as timing belts 10 laid atop toothed racks 18, all of which are disposed along both lateral ends 4 of the support frame 2. Completing the mechanism is a rotary actuator 38 which rotates a drive gear 32, as well as a pair of grooved wheels 26 which are all connected to the tufting frame 20 at each of its vertical supports 30. For simplicity, a discussion of drive mechanism components residing at only a proximal lateral end 4*a* of the support bed 14 will follow, but it should be understood that its distal end 4*b* features a mirror complement of tufting frame drive components which enable the tufting frame 20 to advance along the support frame 2.

Figure 6:
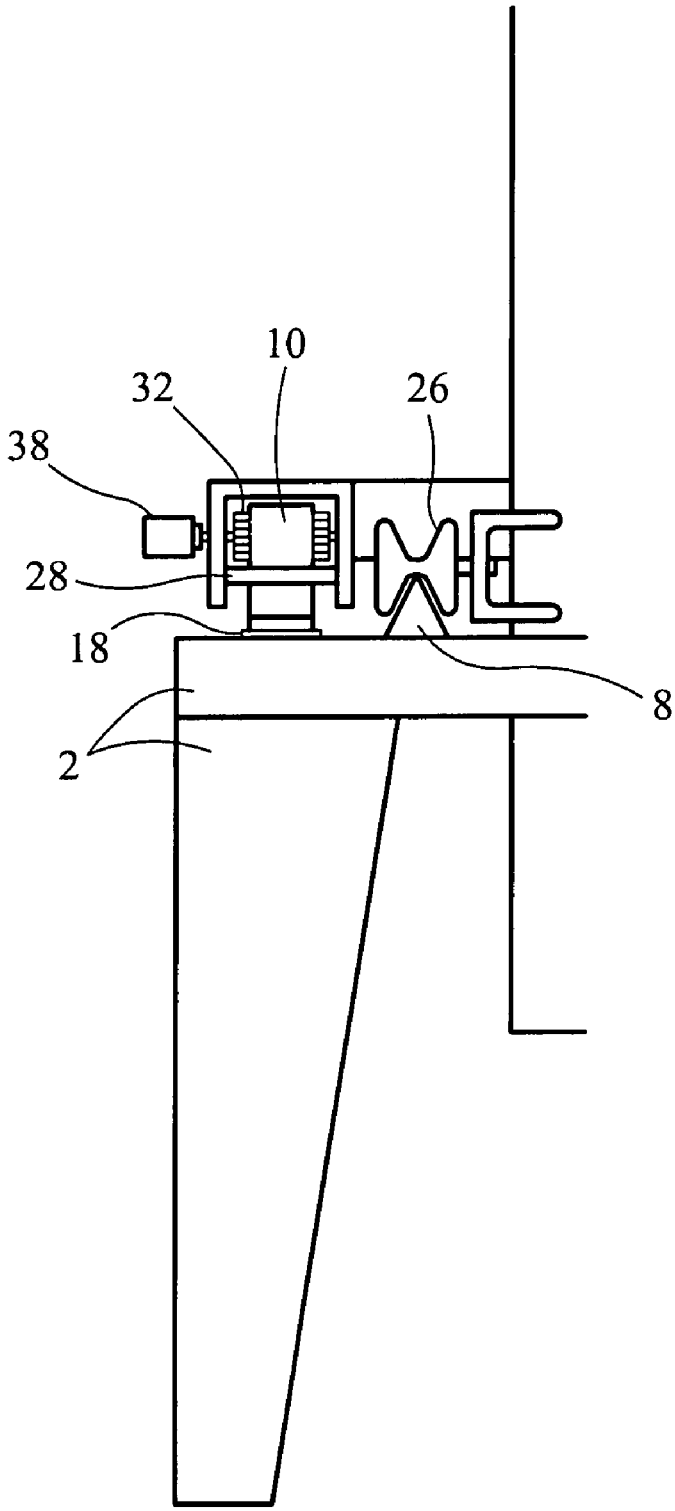
FIG. 6 is an exploded front elevational view of a portion of the tufting frame drive mechanism of an embodiment of the tufting machine of the present invention.

As can be gleaned from FIG. 6, the flat side (bottom) of the toothed rack 18 is adhered to the support frame, and the timing belt 10 is laid atop the rack 18 in mating fashion. The belt 10 and rack 18 are fastened together at their respective ends which are near the longitudinal ends 6 of the support frame 2. At the meeting of the tufting frame 20 and support frame 2, the timing belt 10 is lifted from the rack 18 by virtue of it wrapping over a drive gear 32 fixed to the rotary actuator 38. Preferably, the rotary actuator 38 is a servo motor that is controlled by the computer 100. The drive gear 32 is situated between the timing belt 10 and rack 18, and it remains toothingly engaged to the timing belt 10. Guide rollers 28 stationed on opposite sides of the drive gear 32 cause the timing belt 10 to wind over the gear 32 and maintain contact with at least half of its circumference. Furthermore, the considerable weight of the tufting frame is supported at the engagement of the tufting frame-mounted grooved wheels 26 and the support frame-mounted rails 8. So, when the servo 38 rotates the drive gear 32, the gear 32 advances along the belt 10, and the tufting frame 20 advances in a Y-direction along the support frame 2. However, it should be understood that a variety of linear motion systems for advancing the tufting frame 20 could be substituted for the rack and gear assembly just described. For example, a tufting frame drive mechanism could be in the form of a shaft and bearing assembly comprising pillow block bearings affixed to the tufting frame 20 and mounted to a pair of motor-driven roller screws which are rotatably fixed to the support frame 2.

Referring back to FIG. 4, running atop the upper beam 22 of the tufting frame 20 is a strip of timing belt 34*a*, the ends of which are fastened to the beam 22. Along the front face of the upper beam 22 is a rail 36*a* which runs parallel to the belt 34*a*. The lower beam 24 features an identical belt 34*b* and rail 36*b*. These belt and rail arrangements are parts of identical linear motion systems which enable tufting components mounted thereupon to travel in X-directions along the tufting frame 20. In fact, as will be explained in further detail, the "tufting head" of the present machine is actually formed by two yarn manipulating carriages 50, 70 which are not mechanically connected, but rather are mounted on the separate tufting frame beams 22, 24 and are independently motorized.

Figure 2:
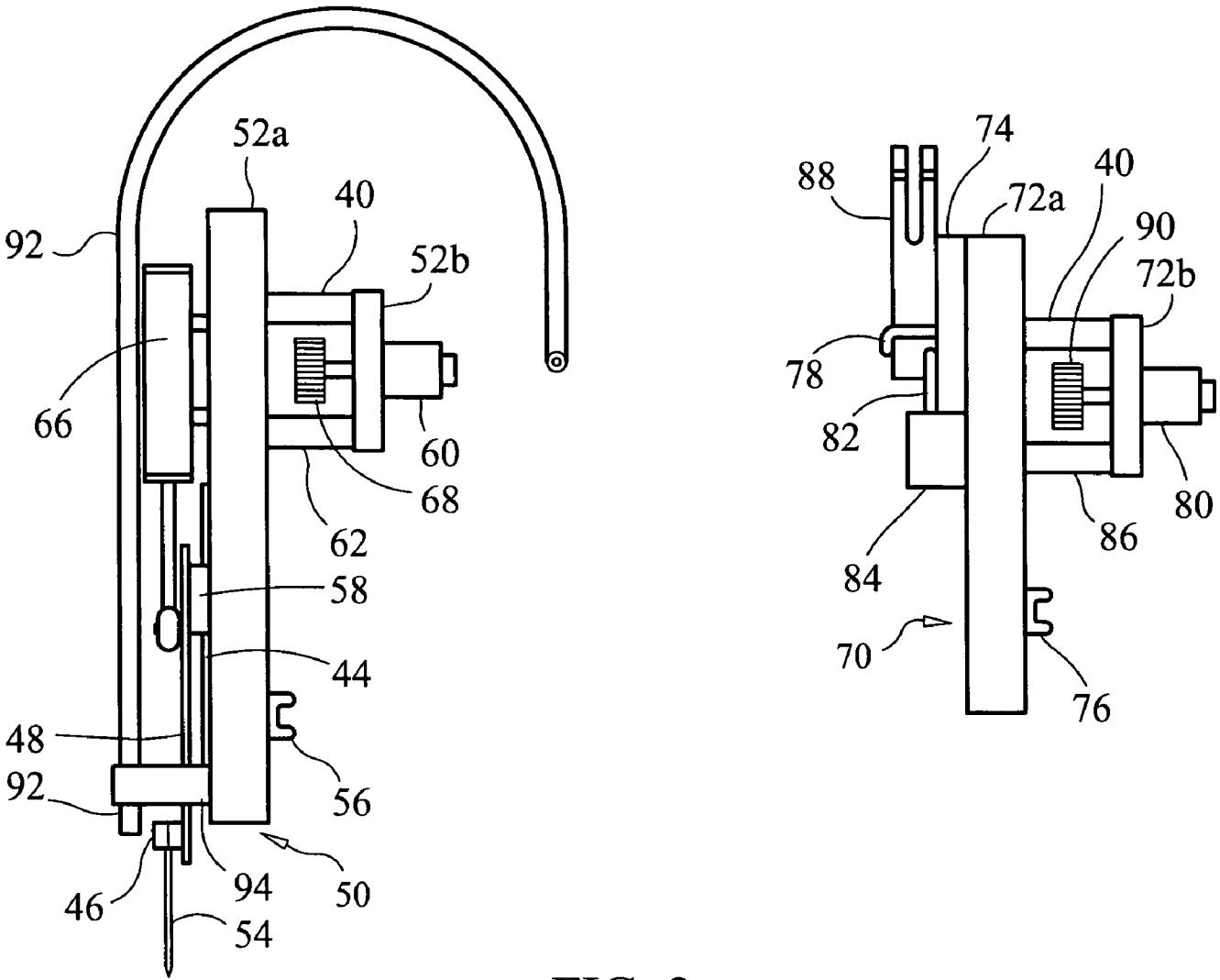
FIG. 2 is an exploded side elevational view of the needle carriage and looper carriage of an embodiment of the tufting machine of the present invention.
Figure 7:
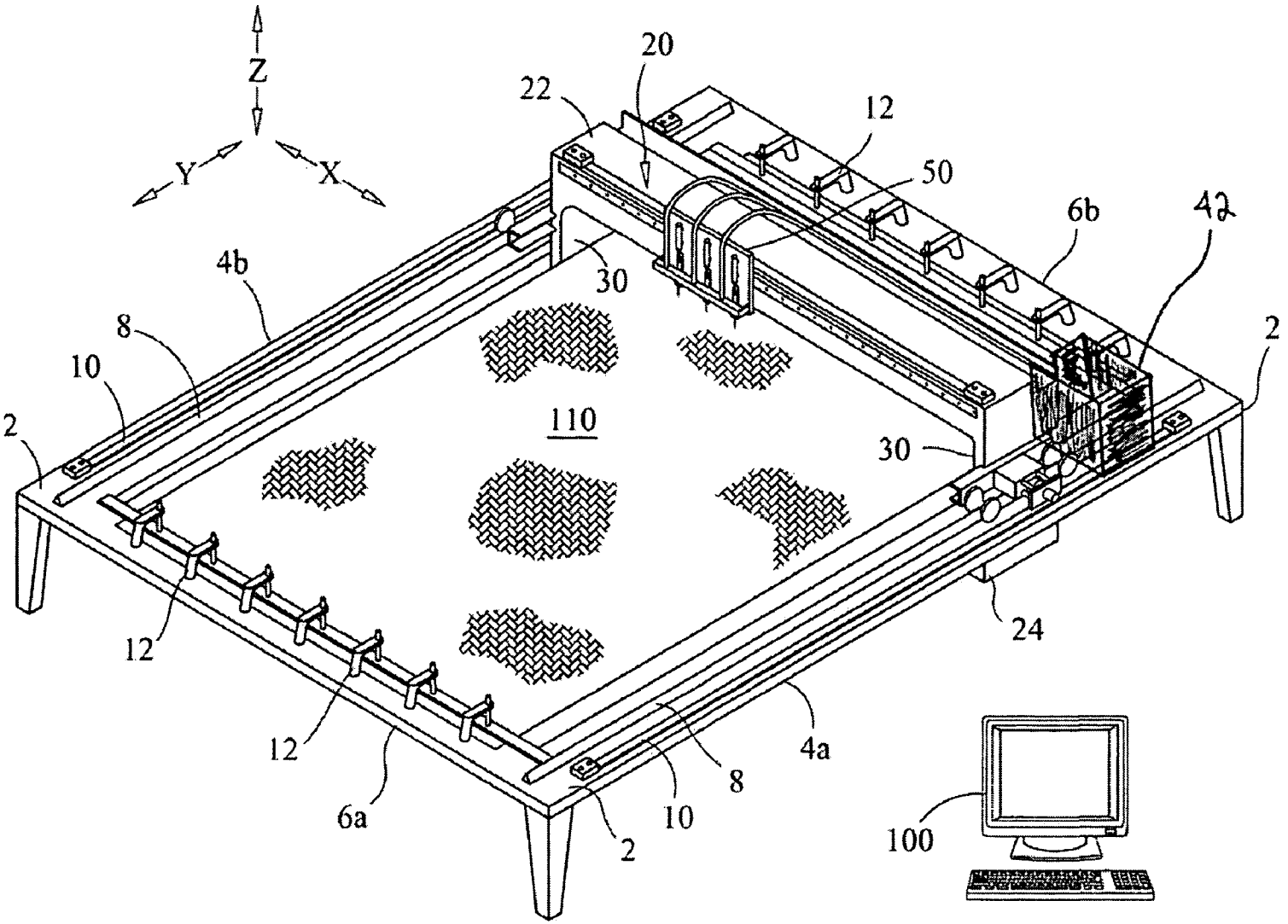
FIG. 7 is a perspective view of an embodiment of the tufting machine of the present invention.

Forming an upper portion of the tufting head assembly is a needle carriage 50 that introduces yarns (not shown) into the backing 110. The needle carriage 50 can have virtually any configuration so long as it includes means for reciprocating individual yarn needles and its travel along the upper beam 22 is computer-controlled. Nevertheless, in the embodiment depicted in FIG. 2, the needle carriage 50 includes a parallel pair of vertically disposed base plates 52 which are coupled together by a connector piece 40 and guide rollers 62. As shown in FIG. 1, a series of tufting needles 54 aligned along a common X-axis are attached to the front base plate 52*a* via individual needle drive mechanisms which reciprocate the needles 54 along their respective Z-axes. The needles 54 can be driven by a variety of means. In the particular embodiment illustrated, an expandable and contractible pneumatic drive assembly 66 controlled by the computer 100 is attached to the front face of the front base plate 52*a* in vertical disposition. The lower end of the pneumatic assembly 66 is attached to a slide plate 48 that slides along the front base plate 52*a*. More specifically, a recirculating linear bearing 58 attached to the rear surface of the slide plate 48 engages a vertical slide rail 44 disposed along the front surface of the front base plate 52*a*. Attached to the front surface of the slide plate 48 is a needle mounting block 46 to which a tufting needle 54 is anchored. So, when the computer 100 signals the pneumatic drive assembly 66 to extend, the slide plate 48 and, therefore, needle 54 are driven downward and vice versa. Different colored yarns which originate from spools housed within a creel 42 attached to the tufting frame 20 (see FIG. 7) each pass through a tube 68 to a tufting needle 54 disposed adjacent the end of the tube 68. The described needle arrangement is duplicated along the needle carriage 50 for at least as many different yarns are to be sewn into a backing piece 110.

Attached to the rear base plate 52*b* of the needle carriage 50 is a carriage drive mechanism comprising a servo motor 60 that propels the needle carriage 50 along the tufting frame 20 by rotating a gear 68 that is engaged to the upper beam's timing belt 34*a*. The computer 100 signals this servo motor 60 to rotate the gear 68 in either rotational direction in order to shift the needle carriage 50 in a linear X-direction. Additionally, to guide and stabilize the needle carriage along the upper beam 22, a slide bearing 56 attached to the rear face of the front base plate 52*a* slides along the beam's rail 36*a*.

It is anticipated that the needle carriage 50 will construct lateral rows of tufts in succession along the backing 110 in forming the graphic design stored in the computer 100 (or at least the segment of that design that is to be projected onto a particular backing piece 110). Accordingly, at the commencement of tufting operations, the tufting frame 20 is to be positioned at the rearward longitudinal end 6*b* of the support frame 2 and the needle carriage 50 at the proximal lateral end 4*a* of the tufting frame 20. The computer 100 will then communicate with the needle carriage's servo motor 60 to incrementally advance the carriage 50 along the upper beam 22. Simultaneously, the computer 100 communicates with the pneumatic assemblies 66 to selectively reciprocate individual needles 54. To wit, a needle 54 is selected to thrust down into the backing 110 after the needle carriage 50 shifts that needle 54 over one of its designated tuft positions along the backing 110. Some needle 54 is selected to reciprocate at each tuft position along the forming lateral tuft row according to the yarn color designated for insertion at that position. Construction of a row is completed when the needle carriage 50 finally arrives at the distal lateral end 4*b* of its beam 22. Then, the tufting frame's synchronized motors 38 shift the tufting frame 20 forward so that the creation of a new tuft row can begin. The use of servo motors to shift the needle carriage 50 and tufting frame 20 allows the pitch between each tuft of yarn within a tuft row and the gauge between successive rows to be precisely controlled. Consequently, the apparatus 1 is capable of producing pixelated patterns of yarn tufts that approach photographic appearance.

Referring back to FIG. 4, the lower portion of the tufting head is formed by a looper carriage 70. While the needle carriage 50 inserts different yarns into the backing 110 in accordance with a predefined pattern, the looper carriage 70 catches, holds and cuts the inserted yarn to form cut pile tufts along the backing 110. In a preferred embodiment illustrated in FIGS. 1 & 2, the looper carriage 70, much like its counterpart needle carriage 50, is formed by, among other things, two vertical base plates 72 joined by a connector piece 40 and guide rollers 86. Like the needle carriage 50, attached to the looper carriage's rear base plate 72*b* is a servo motor 80 that rotates a gear 90 engaged the timing belt 34*b* atop the lower beam 24. Also, another slide bearing 76 residing on the rear face of the looper carriage's front base plate 72*a* engages the slide rail 36*b* along lower beam 24 so that the looper carriage stably travels along the beam 24.

Coupled to the front face of the front base plate 72*a* is a smaller mating plate 74. A looping device 78 projects forward from the mating plate 74. Preferably, the looper 78 can be adjustably mounted at a range of vertical positions along the mating plate 74. Screwed to the mating plate 74 is an L-shaped foot device 88 that has a vertical portion extending up to the backing sheet 110 and a horizontal portion spanning over the looper 78 and providing localized support underneath the backing 110 so that the backing 110 does not deflect downward as it is penetrated by a needle 54. A central opening within the foot 88 receives a stroking needle 54. Finally, to enable production of cut pile tufts, a cutting knife 82 is also attached to the front base plate 72*a* of the looper carriage 70. The knife 82 is rocked back and forth along a vertical plane by a knife drive mechanism 84 of a type well-known in the art.

In operation, as the computer 100 directs the needle carriage 50 to travel across the upper beam 22 in order to tuft a yarn row in the manner described above, it simultaneously orders the servo motor 80 to position the looper carriage 70 so that its looping device 78 catches the yarn of the particular needle 54 that is penetrating the backing 110 at a given moment. Since a single looper 78 is tasked with interacting with multiple needles 54 along the needle carriage 50, when a yarn color change occurs (i.e., a different needle 54 is selected to reciprocate), either the needle carriage 50 or the looper carriage 70 must shift relative to the other carriage so that the looper 78 is properly aligned with the particular one of the needles 54 about to stroke. As the stroking needle 54 returns upward, the looper 78 snags its yarn in conventional manner and forms a yarn loop below the backing 110. The knife drive mechanism 84 can be programmed to immediately thereafter rock the knife 82 and sever the just formed loop. Alternatively, the looper carriage motor 80 and knife drive 84 can be programmed to allow multiple yarn loops to gather on the looper 78 prior to actuating the knife 82. In any event, because the vertical position of the foot 88 is fixed along the looper carriage 70, manually raising the mount position of the looper 78 on the front base plate 72*a* prior to operation will effectively shorten the height of tuft piles produced in the backing 110, and vice versa.

What is claimed is:

1. A tufting machine for producing athletic turf having a graphic design, the tufting machine comprising:

(a) a support frame to which a backing fabric can be fastened and statically held in plane;

(b) a tufting frame that is movably mounted to the support frame and travels thereupon along a Y-axis, wherein the tufting frame comprises a first beam that spans across the backing and is oriented along an X-axis and a second beam that is oriented parallel to the first beam and opposite the backing;

(c) a first carriage that is movably mounted to the first beam and travels thereupon along an X-axis;

(d) at least two tufting needles that are disposed within the first carriage, wherein each needle receives a different type of yarn and is selectively reciprocated, along a Z-axis, in order to insert its designated yarn into the backing in accordance with the graphic design;

(e) a second carriage that is movably mounted to the second beam and travels thereupon along an X-axis;

(f) a looper disposed within the second carriage, the looper for catching yarn inserted through the backing by a needle and thereby forming a loop tuft along the backing;

(g) a tufting frame drive mechanism capable of advancing the tufting frame along the support frame;

(h) a first carriage drive mechanism capable of advancing the first carriage along the first beam;

(i) a second carriage drive mechanism capable of advancing the second carriage along the second beam;

(j) needle drive mechanisms capable of reciprocating the needles individually;

(k) a computer for storing the graphic design and for selectively controlling the various drive mechanisms in accordance with the graphic design; and (l) wherein the first and second carriages are independently driven so that the second carriage may be precisely positioned, relative to the first carriage, to enable the looper to catch yarn from a particular reciprocating needle.

2. The tufting machine of claim 1, further comprising a cutter disposed on said second carriage, the cutter for severing loop tufts formed along the backing and thereby rendering cut pile tufts.

3. The tufting machine of claim 1, further comprising a foot disposed on said second carriage, the foot for receiving needles as they are inserted through the backing and for preventing the backing from deflecting toward said looper, wherein the distance, along a Z-axis, between the foot and said looper determines the height of the tufts to be formed and wherein that distance can be selectively adjusted.

4. The tufting machine of claim 1, further comprising a yarn feed source that is operatively connected to said tufting frame, wherein the yarn feed source holds different yarns that are delivered to said needles, and wherein each yarn is delivered to a separate needle.

5. The tufting machine of claim 1, wherein said tufting frame drive mechanism comprises:

(a) a rack and gear assembly comprising a toothed rack attached to said support frame and a gear attached to said tufting frame, wherein the gear advances along the rack when the gear is rotated, thereby causing said tufting frame to advance along said support frame; and (b) a motion actuator that rotates the gear.

6. The tufting machine of claim 5, wherein said motion actuator comprises a servo motor.

7. The tufting machine of claim 5, wherein said tufting frame drive mechanism further comprises a guide assembly for guiding the movement of said tufting frame along said support frame.

8. The tufting machine of claim 7, wherein said guide assembly comprises:

(a) a rail attached to said support frame, wherein the rail runs parallel to said rack; and (b) wheels attached to said tufting frame and engaged to the rail, wherein the wheels roll along the rail due to said gear's advancement along said rack.

9. The tufting machine of claim 1, wherein said tufting frame drive mechanism comprises:

(a) a shaft and bearing assembly comprising a threaded shaft rotatably attached to said support frame and a rotary bearing attached to said tufting frame and engaged to the threaded shaft, wherein the rotary bearing advances linearly along the threaded shaft when the threaded shaft is axially rotated, thereby causing said tufting frame to advance along said support frame; and (b) a motion actuator that axially rotates the threaded shaft.

10. The tufting machine of claim 9, wherein said motion actuator comprises a servo motor.

11. The tufting machine of claim 1, wherein said first carriage drive mechanism comprises:

(a) a rack and gear assembly comprising a toothed rack attached to said first beam and a gear attached to said first carriage and engaged to the rack, wherein the gear advances along the rack when rotated, thereby causing said first carriage to advance along said first beam; and (b) a motion actuator that rotates the gear.

12. The tufting machine of claim 11, wherein said motion actuator comprises a servo motor.

13. The tufting machine of claim 11, wherein first carriage drive mechanism further comprises a guide assembly for guiding the movement of said first carriage along said first beam.

14. The tufting machine of claim 13, wherein said guide assembly comprises:

(a) a rail attached to said first beam, wherein the rail runs parallel to said rack; and (b) a linear bearing attached to said first carriage, wherein the linear bearing slides along the rail due to said gear's advancement along said rack.

15. The tufting machine of claim 1, wherein said second carriage drive mechanism comprises:

(a) a rack and gear assembly comprising a toothed rack attached to said second beam and a gear attached to said second carriage and engaged to the rack, wherein the gear advances along the rack when rotated, thereby causing said second carriage to advance along said second beam; and (b) a motion actuator that rotates the gear.

16. The tufting machine of claim 15, wherein said motion actuator comprises a servo motor.

17. The tufting machine of claim 15, wherein second carriage drive mechanism further comprises a guide assembly for guiding the movement of said second carriage along said second beam.

18. The tufting machine of claim 17, wherein said guide assembly comprises:

(a) a rail attached to said second beam, wherein the rail runs parallel to said rack; and (b) a linear bearing attached to said second carriage, wherein the linear bearing slides along the rail due to said gear's advancement along said rack.

19. A tufting machine for producing athletic turf having a graphic design, the tufting machine comprising:

(a) a support frame to which a backing fabric is fastened and statically held in plane;

(b) multiple tufting frames that are movably mounted to the support frame and travel thereupon along a Y-axis, wherein each tufting frame comprises a first beam that spans across the backing and is oriented along an X-axis and a second beam that is oriented parallel to the first beam and opposite the backing;

(c) at least one needle carriage that is movably mounted to the first beam of each tufting frame and travels thereupon along an X-axis;

(d) at least two tufting needles that are disposed within each needle carriage, wherein each needle receives a different type of yarn and is selectively reciprocated, along a Z-axis, in order to insert its designated yarn into the backing in accordance with the graphic design;

(e) at least one looper carriage that is movably mounted to the second beam of each tufting frame and travels thereupon along an X-axis;

(f) a looper disposed within each looper carriage, the looper for catching yarn inserted through the backing by a needle and thereby forming a loop tuft along the backing;

(g) tufting frame drive mechanisms capable of advancing the tufting frames independently along the support frame;

(h) needle carriage drive mechanisms capable of advancing the needle carriages independently along the respective first beams to which they are mounted;

(i) looper carriage drive mechanisms capable of advancing the looper carriages independently along the respective second beams to which they are mounted;

(j) needle drive mechanisms capable of reciprocating the needles individually;

(k) a computer for storing the graphic design and for selectively controlling the various drive mechanisms in accordance with the graphic design; and (l) wherein the looper and needle carriages are independently driven so that each looper carriage may be precisely positioned, relative to a needle carriage, to enable its looper to catch yarn from a particular reciprocating needle.

* * * * *